US006260246B1

(12) United States Patent
Lampkins

(10) Patent No.: US 6,260,246 B1
(45) Date of Patent: Jul. 17, 2001

(54) STAY TIE

(76) Inventor: Gary Wallace Lampkins, 1501 Aragona Blvd., Ft Wash., MD (US) 20744

( * ) Notice: Subject to any disclaimer, the term of this patent is extended or adjusted under 35 U.S.C. 154(b) by 0 days.

(21) Appl. No.: 09/369,203

(22) Filed: Aug. 6, 1999

(51) Int. Cl.[7] ..... A43C 7/00

(52) U.S. Cl. ..... 24/712.1; 24/712.6; 24/713; 24/713.6

(58) Field of Search ..... 24/712.1, 712.6, 24/713, 713.6

(56) References Cited

U.S. PATENT DOCUMENTS 948,460 * 2/1910 Partridge ..... 24/712.6
1,055,048 * 3/1913 Kennedy ..... 24/712.6
1,104,259 * 7/1914 Gwirtz ..... 24/712.6
4,790,048 * 12/1988 Arnt ..... 24/712.1
5,372,510 * 12/1994 Stanfield ..... 24/115 H
6,016,590 * 1/2000 Malone ..... 24/712.1

* cited by examiner

*Primary Examiner*—Victor N. Sakran

(57) ABSTRACT

The devices sole function is to aid the shoelace once tied in obtaining its ultimate purpose of securing the shoe about the foot. This is done by the device being placed on both sides of the knot and fastening the excess lace in a manner to alleviate slippage of the knot, the bow and the excess lace.

4 Claims, 3 Drawing Sheets

STAY TIE

BACKGROUND OF THE INVENTION

One of the most troubling occurrences to shoes and their function is the frequency of the slippage of the shoelace knot once it has been tied. This is dangerous when participating in any type of athletic activity or something as fundamental as walking. Moreover, most young children are unaware of the danger of an untied shoe and the severity of the injury it can cause when they inadvertently step on the loose lace with their other foot and cause themselves to trip. Needless to say it is quite painful especially when the front teeth are lost in the process. In Stanfield U.S. Pat. No. 5,372,510 where a device was designed to aid handicapped children in tying a bow in a shoelace that is mounted to a shoe. In short, prior art does not provide a remedy for slippage of the knot on both sides of the knot once the shoelace has been tied, nor address the semi or permanent need for placement of the device on the shoe itself to eliminate loss or destruction.

SUMMARY OF THE INVENTION

The primary function of the present invention is to keep shoelaces that have been tied in the traditional knot with bows on each side securely fastened in the tied state. The device has two clamping members, with a locking system to add strength and reliability, which are joined together by a flexible arm. Once in place, the device will secure the excess laces and bow on both sides of the knot. This will keep the knot tightly affixed. Also the device has an adjoining flexible arm in the shape of an oval with a stiff end or tip to aid in the device being placed through the top shoelace hole. Once through the shoelace hole the device will be inserted through the oval flexible arm forming a noose around the surrounding shoe material, semi affixing the device to the shoe. The following drawings accompanied by the preferred embodiments will fully describe the unique, practical usefulness of the invention.

DESCRIPTION OF THE PREFERRED EMBODIMENTS

Figure 1:
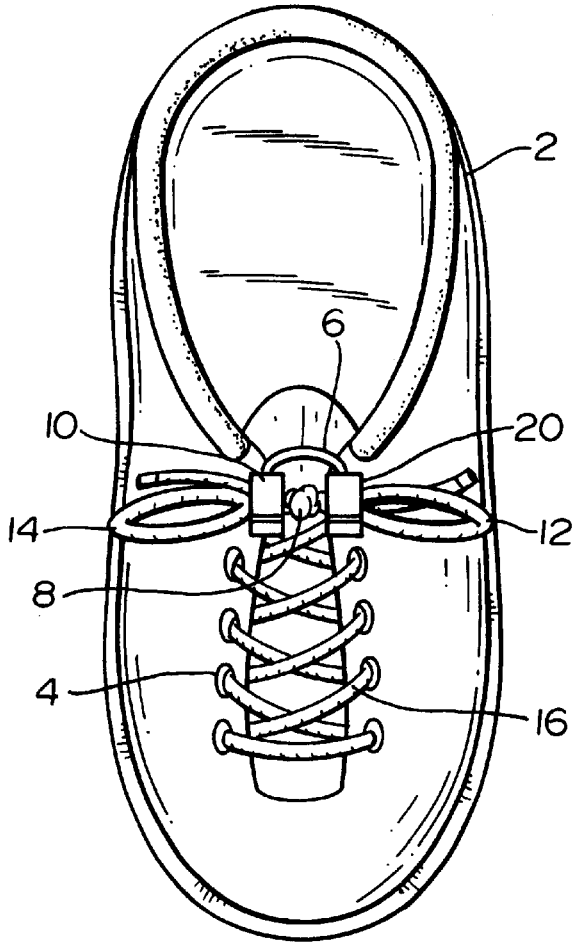
FIG. 1 is a top view of a shoe with the device incorporated and engaged.
Figure 2:
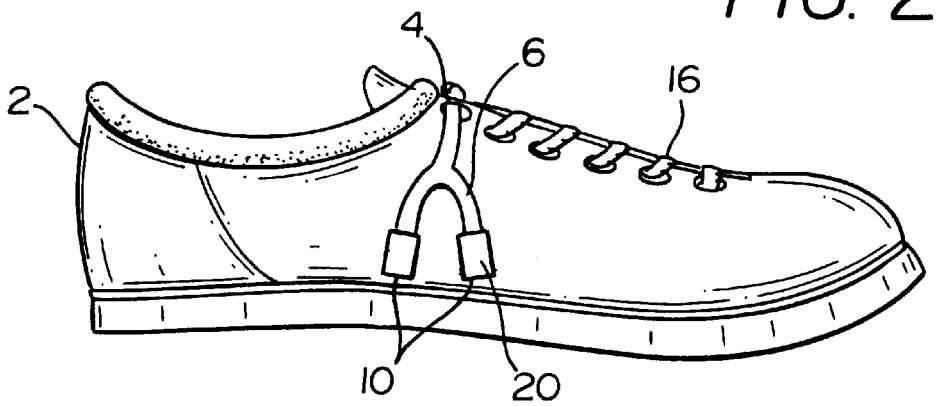
FIG. 2 is a side view of a shoe and the device hanging unengaged.
Figure 3:
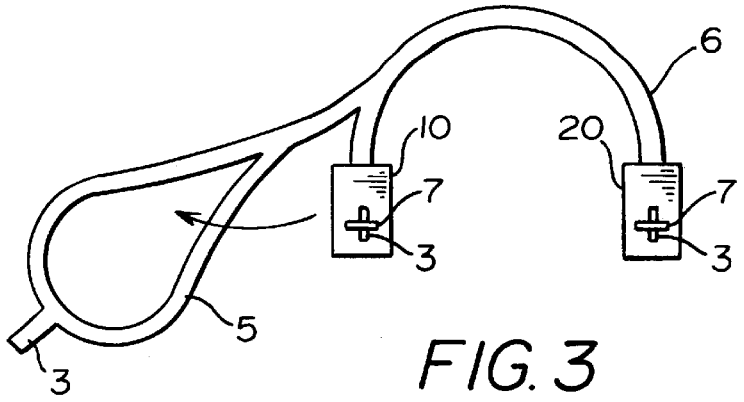
FIG. 3 is a top view of the device.
Figure 4:
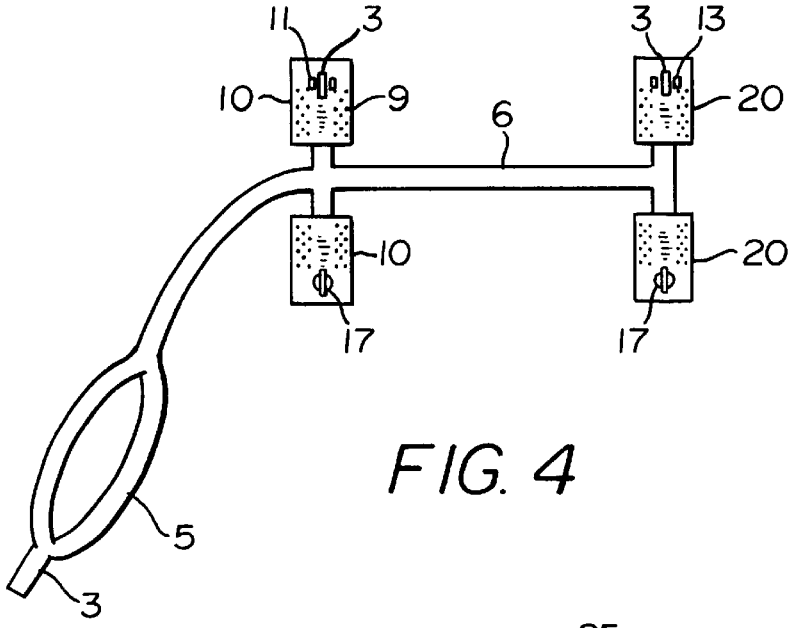
FIG. 4 is an open view of the device.
Figure 5:
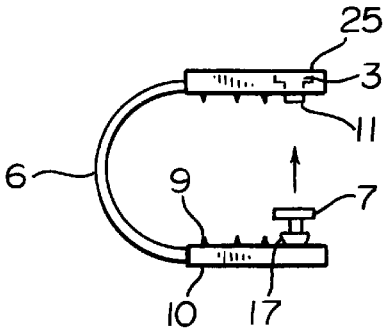
FIG. 5 is a side view of one of the clamps unengaged showing the teeth and the locking mechanism.
Figure 6:
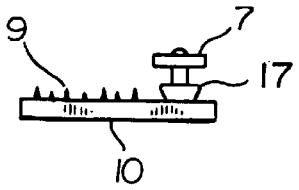
FIG. 6 is a side view of the bottom half of a clamp displaying its teeth and twist lock.
Figure 7:
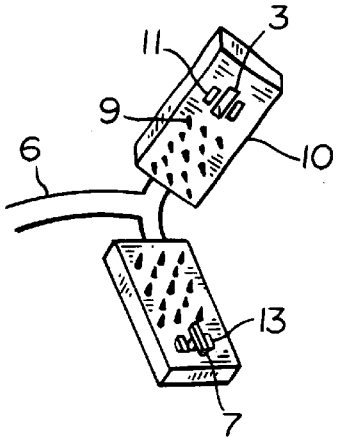
FIG. 7 is an open view of a clamp displaying the teeth, hole, locking apparatus and flexible arm that connects one clamp to the other.
Figure 8:
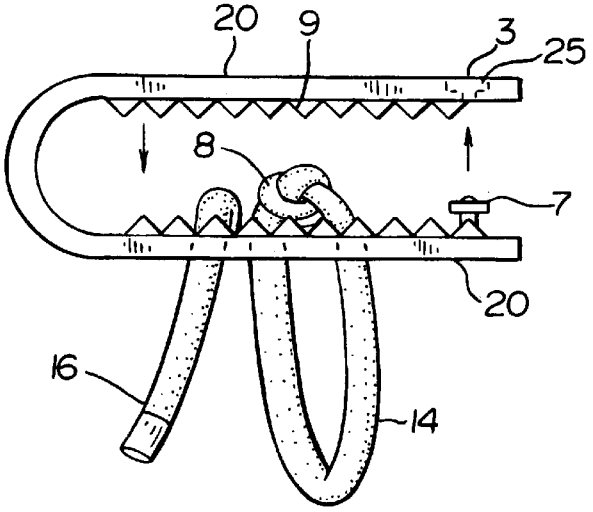
FIG. 8 is a side view of a clamp with a tie shoelace in-between the clamp.

FIG. 1 illustrates a shoe 2 and the position of the apparatus with the clamps 10 and 20 engaged and fastened about the shoelace 16, the bows 12, and 14. Clamps 10 and 20 are placed one on either side of the knot 8 to keep the knot 8, the bows 14 and 12 and the shoelace 16 tightly bound to preclude slippage of the knot 8 and bows 12 and 14. FIG. 2 illustrates a side view of a shoe 2 and the apparatus hanging unengaged through a hole 4 displaying the apparatuses semi permanent position when it is not in use. FIG. 3 illustrates the entire apparatus removed from the shoe 2 and how clamps 10 and 20 are connected by an arm 6 which viers off to form a loop 5 with a tip 3 on its end to aid the device in being inserted through the upper hole 4 of a shoe 2. Once the tip 3 and the loop 5 have been inserted through the hole 4, clamps 10 and 20, and the arm 6 will be inserted through the loop 5 to form a noose through and around the upper hole 4 and the upper material of the shoe 2. The apparatus, by being semi attached, allows it to be readily available when needed and to avoid loss or misplacement. FIG. 4 Illustrates the apparatus with clamps 10 and 20 open to display the teeth 9 whose purpose is to bite into the shoelace 16 to keep it from slipping through clamps 10 and 20. FIG. 4 also illustrates the prongs 11 and 13 whose main function is to engage a latch 17 to keep the clamping parts of 10 and 20 securely fastened. Both clamps have a hole 3 in-between latches 11 and 13. Stem 7 serves as a back up or safety locking mechanism that inserts through the hole 3 of both clamp members 10, and 20. Once the stem 7 is inserted through the hole 3 the head of stem 7 will swivel to a locking position in a groove 25. FIG. 5 illustrates a side view of the clamp 10 and the apparatuses members responsible for the effectiveness of holding the shoelace in a tied state. FIG. 5 further illustrates the Stem 7 and how it will be inserted through the hole 3 and locked in place in the groove 25, with a prong 11 engaging the latch 17. Once the clamp 10 is closed the teeth 9 will hold the knot 8, the bows 12 and 14, and the shoelace 16 tightly fastened. FIG. 6 illustrates the bottom half of the clamp 10 and the location of the teeth 9, the latch 13 and the stem 7. FIG. 7 illustrates an open view of the inventions members to further demonstrate the positions of the clamp 10, the teeth 9, the prongs 11, the hole 3, the stem 7, the latch 13 and the arm extension 6. The clamps 10 and 20 will snap together the same as a traditional hair barrette except for the added feature of a stem 7 and a hole 3 in the top of the clamps 10 and 20. The stem 7 once inserted through the hole 3 will pivot or turn until it comes to rest in the groove 25. This locking system will securely fasten the shoelace 16 and bows 12 and 14 and the knot 8 in place. This invention allows the shoelace 16 to fulfill its ultimate purpose of securely tightening the shoe 2 about the foot. FIG. 8 illustrates a clamp 20 with a tied shoelace bow 14 and excess lace 16 resting in-between and on the teeth 9. Once the stem 7 is inserted in the hole 3 and twisted and locked in place in the groove 25, the force of the closure of the clamp 20 will fixate the bow 14 and the lace 16 in place and preserve the integrity of the knot 8.

I claim:

1. A combination shoe and shoelace retaining device comprising of two clamping members joined together by an extension with both clamping members having an upper, and a lower part, with a locking member that connects and fastens the upper with the lower part on both clamping members, consequently retaining a tied and bowed shoelace in-between said parts of the closed and locked clamping members on both sides of the knot, thereby precluding the tied and bowed shoelace from becoming unraveled, wherein an additional flexible arm in the shape of a loop is made a part of the shoelace retaining device, whereby, said device can be placed on and removed from the shoe by insertion of said device through a shoelace hole and through said loop, in essence, forming a noose around the upper of said shoe.

2. A combination shoe and shoelace retaining device described in claim 1 wherein the device is permanently attached to the shoe.

3. A combination shoe and shoelace retaining device described in claim 1 wherein the flexible arm is perminantly attached to a shoe.

4. A combination shoe and shoelace retaining device described in claim 1 wherein the inner portion of the clamps has a material or member attached thereto that precludes slippage of shoelaces once said clamps are closed.

* * * * *